United States Patent [19]

Talikka

[11] 4,170,495

[45] Oct. 9, 1979

[54] METHOD AND MEANS FOR HARDENING AND HOT-ZINCING IRON AND STEEL PRODUCTS

[76] Inventor: Raimo Talikka, 27110 Irjanne, Finland

[21] Appl. No.: 701,753

[22] Filed: Jun. 30, 1976

[30] Foreign Application Priority Data

Jul. 3, 1975 [FI] Finland ..... 751952

[51] Int. Cl.[2] ..... C21D 1/48

[52] U.S. Cl. ..... 148/15; 148/18; 148/20; 148/144

[58] Field of Search ..... 148/15, 18, 20, 20.6, 148/143, 144, 16.7, 12.1; 118/400; 427/383 R, 433, 434

[56] References Cited

U.S. PATENT DOCUMENTS

| | | | |
|---|---|---|---|
| 2,110,893 | 3/1938 | Sendzimir | 148/16.7 |
| 2,396,730 | 3/1946 | Whitfield et al. | 148/15 |
| 2,656,285 | 10/1953 | Burns et al. | 148/12.1 |
| 2,797,173 | 6/1957 | Keller | 148/15 |
| 2,797,177 | 6/1957 | Keller | 148/15 |
| 2,857,300 | 10/1958 | Moller | 148/15 |
| 3,053,704 | 9/1962 | Munday | 148/20 |
| 3,337,376 | 8/1967 | Grange | 148/143 |
| 3,922,181 | 11/1975 | Woodilla et al. | 148/15 |
| 4,029,478 | 6/1977 | Lee | 427/433 |
| 4,056,366 | 11/1977 | Lee et al. | 427/433 |
| 4,056,657 | 11/1977 | Leckie et al. | 427/433 |

OTHER PUBLICATIONS

Lyman, T, *Metals Handbook,* vol. II, (Heat-Treating, Etc.), Cleveland (ASM), 1964, p. 500.

*Primary Examiner*—L. Dewayne Rutledge
*Assistant Examiner*—John P. Sheehan
*Attorney, Agent, or Firm*—Haseltine, Lake & Waters

[57] ABSTRACT

A method for hot-zincing and hardening iron and steel products. After removing grease from the products they are heated to austenitizing temperature and are subsequently introduced directly into a zinc bath for simultaneous zincing and hardening.

9 Claims, 2 Drawing Figures

METHOD AND MEANS FOR HARDENING AND HOT-ZINCING IRON AND STEEL PRODUCTS

The present invention relates to a method for hot-zincing iron and steel products, in which method grease is first removed from the products to be treated, whereupon the products are heated up to the austenitizing temperature. The invention also relates to means for performing said method.

The so-called dipping method presently used is quite limited. As regards screw products, it is possible to hot-zinc untempered screws. Hardened screws, i.e. hard screws of the strength classes 8.8 and 10.9, cannot be hot zinced by the dipping method without deterioration of the strength qualities of the steel during the zincing process.

Working conditions and requirements of protection of environment present problems in the dipping method in use. The worker has to handle poisons of class II. Alkali and acid treatments cause risk situations and, moreover, require efficient additional ventilation. The lyes, acids, and washing waters used in the process must be passed to waste-water cleaning plant for treatment. This increases the expenses of the method to a considerable extent.

An object of the invention is to provide a hot-zincing method that eliminates the drawbacks of the method in present use: uneven quality, limited range of use for steels, unpleasant and dangerous working conditions, and expensive treatment of waste-waters.

The method in accordance with the present invention is characterized in that the heated objects are introduced directly into a zinc bath in order to hot-zinc the objects and, at the same time, to cool them. The objects are removed from the zinc bath within a predetermined period of time, whereupon excess zinc is removed from the objects.

The present invention also relates to means for performing the method, which means comprise a washing device for cleaning the objects to be treated, a heat-treatment furnace, a zinc container for zincing the objects to be treated. The zinc container is arranged in connection with the heat-treatment furnace so that the objects to be treated come from the furnace straight into the zinc bath in the zinc container and the zinc container is provided with a transfer means for lifting the objects to be treated out of the zinc bath after a predetermined period of time. Below, the invention will be described more in detail with reference to the attached drawing.

Figure 1:
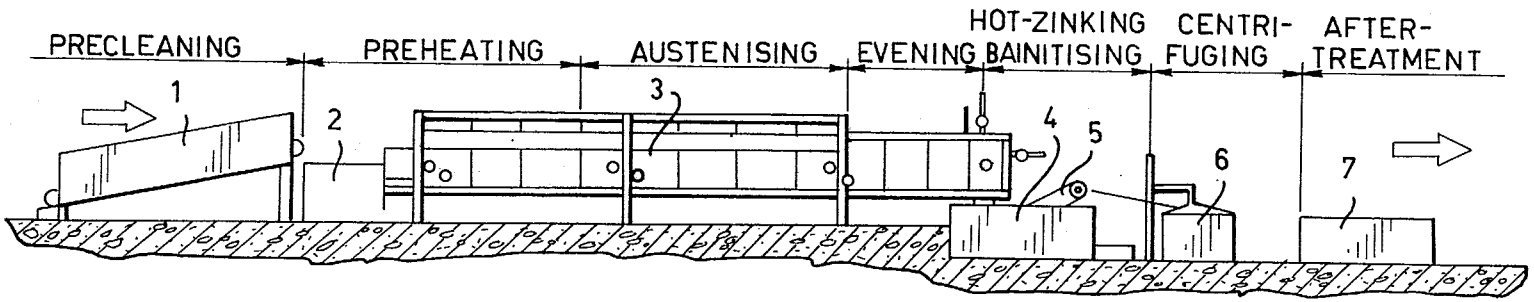
Figure 2:
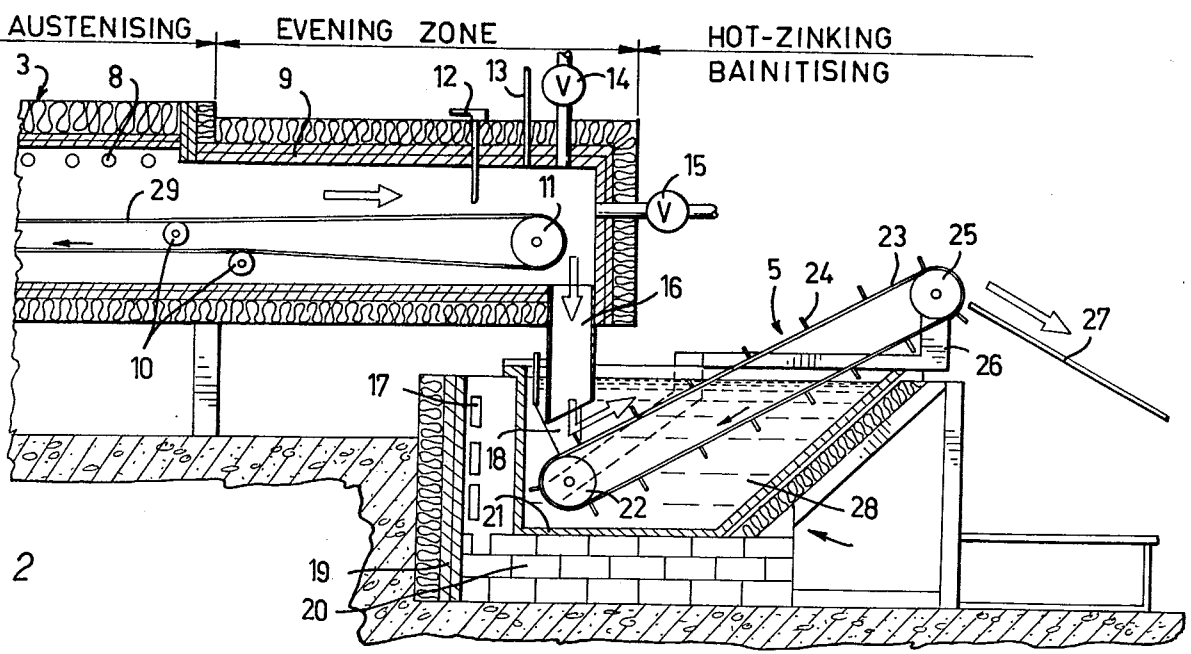

FIG. 1 schematically illustrates the various parts of the means used for performing the method in accordance with the invention, and FIG. 2 illustrates the end section of the heat-treatment furnace and the zinc boiler more in detail.

The hot-zincing method in accordance with the invention comprises the following main steps:

1. Removal of grease
2. Heat-treatment
3. Zincing
4. Centrifuging
5. Cooling

After conventional removal of grease, the objects are carried in a continuous even flow into the heat-treatment furnace. In the first zone of the furnace, the objects are cleaned while moving slowly in a reducing atmosphere. In the second zone of the furnace, the heating zone, the objects to be treated are heated to temperatures required for hardening which is included in the process. The operating temperature of this zone lies between 850 and 1000° C. In the third zone of the furnace, the evening zone, containing a protective gas free of carbon compounds the temperature of the object is evened down to the appropriate level before the object comes into the zinc container. The temperature must not sink below a certain so-called $A_{c3}$—temperature. In the furnace is used as protective gas:

(a) so-called ENDO-gas made from propane and consisting of
29.0% Of $H_2$
22.5% of CO
1.0% of $CO_2$
47.5% of $N_2$ (b) protective gas made of ammonia and consisting of
75% of $H_2$
25% of $N_2$ The function of the protective gas (b) is to protect the surface of the objects from coming into contact with oxygen, which would prevent chemical reaction between the zinc and the steel. Moreover, the protecting gas (a) protects the steel from loss of carbon during the heating step. The protective gas (a) must have a certain dew-point in order to have a good protecting effect. For hardening and hot-zincing, the objects are passed from heat-treatment furnace 3 along a protective tube 16 into molten zinc 28 in a zinc container 4. In the container the object sinks slowly onto a carrier belt 23 of an elevator 5 on the bottom of the boiler. When the object comes into contact with the molten zinc 28, the iron (steel) and zinc react with each other. Treatment by runnet is unnecessary. In a container made of steel the temperature of the zinc varies between 450 and 460° C., and if a ceramic container is used the temperature of the molten zinc may alternatively be set in the range of 520 to 560° C. By addition of certain additives to the zinc, it is possible to improve the properties of the zinc plating. The most important additive is aluminum, which increases the flow of the zinc, and it is also possible to add lead. The content of aluminum is 0.16 to 0.18 percent. The aluminum prevents formation of a zinc-iron layer. For hardening, the molten zinc functions as a quenching bath, and the quenching time, i.e. the time spent in the molten zinc, is particularly important for the hardening result achieved. Elevator 5, the speed of which can be adjusted, functions as regulator of the quenching time. The inner coating of the zinc container 4 is denoted with number 21, the heating elements with number 17, the insulation with number 19, and the bottom bricks with number 20. The tube 16 connecting the furnace 3 with the zinc container 4 extends down to underneath the surface of the zinc bath 28. Below the tube 16 there is the elevator 5, onto which the objects to be treated fall and which automatically carries them out of the zinc bath 28. The zincing time is thus the same for each individual object, and this guarantees a layer of zinc and an excellent adhesion. The turning roller of the elevator is mounted by means of stellite rings having a suitable play, which are constantly lubricated efficiently by the molten zinc. In order that the objects should certainly fall onto the belt 23 of the elevator 5, an adjustable guide plate 18 can be arranged as an extension of the tube 16, which plate is preferably punched. The preferably net-shaped belt 23 of the elevator is at appropriate distances provided with so-called lifting irons 24 functioning as grasping units. The frame of the elevator is denoted with number 26, the driving and boiler rollers with numbers 25 and 22, respectively. From the elevator 5 the objects fall onto the transfer duct 27 and from there further into the centrifuge 6. The excess zinc is removed from the screws etc. objects by centrifuging the objects. In the centrifuge the excess zinc becomes loose by the effect of the centrifugal force and is carried onto the walls of the centrifuge. The zinced objects must be passed into the centrifuge without delay, whereby the surface of the zinc remains almost molten. The objects fall one by one into the centrifuge which is rotating, and hereby each screw is treated individually. An excellent result is obtained with each object, and the quality is highly uniform.

This new method of hot-zincing involves two previously separate processes of production. In this process the objects can be hot-zinced with an excellant adhesion and the hardening can be performed together with the zincing at the same time. The hardening applied to this method is known as bainite hardening. This method is well suitable for the process, because the temperature of the zinc in the zinc container is suitable for many low-carbon steels as quenching temperature. Moreover, the method does not require a separate heating step for temper hardening. In the furnace the object reaches the austenitizing temperature, and it is quenched in molten zinc above the $M_s$—temperature and is allowed to stay in the molten zinc long enough so that the structure will have time for almost complete conversion into bainite. After lifting off from the zinc, the object is allowed to cool in the air. By means of the method in accordance with the invention it is also possible to perform stage hardening for suitable steels.

The new method is continuous and guarantees efficient and uniform operation during the production. Intermediate operations depending on the operator are omitted and the process runs smoothly. The operator concentrates on controlling the quality, and this further intensifies the uniform quality of the production. Moreover, the process can be controlled step by step, and this ensures a good zincing result for the object.

What we claim is:

1. A method for simultaneous hardening and hot-zincing of low-carbon steel products consisting of the consecutive continuous steps of heating the products in a furnace to the austenitizing temperature of 850°–1000° C. in an atmosphere of a reducing gas to prevent decarburizing, evening and controlling the temperature of the austenitized products to a temperature not below the $A_{c3}$ temperature in the end zone of said furnace in an atmosphere of a carbon-free protective gas to protect against contact with oxygen, introducing said products directly into a zinc bath at a temperature above the $M_s$ temperature for simultaneous hot-zincing and hardening for a period of time sufficient to produce bainite hardening, removing the hardened zinced products from the zinc bath, removing excess zinc from the products and cooling the products.

2. The method as claimed in claim 1, wherein the reducing gas consists of 20.0% $H_2$, 22.5% CO, 1.0% $CO_2$ and 47.5% $N_2$, and the protective gas consists of 75% $H_2$ and 25% $N_2$.

3. The method as claimed in claim 1, wherein the products to be treated are individually fed in a continuous flow from the heat-treatment furnace into the zinc bath.

4. The method as claimed in claim 1 wherein the products are hardened screws.

5. The method as claimed in claim 4 wherein the screws are of the strength classes 8.8 or 10.9.

6. The method as claimed in claim 1 wherein the temperature of the molten zinc is between 450 and 560° C.

7. The method of claim 1 wherein the temperature of the zinc is between 450 and 460° C. in a steel container or between 520 to 560° C. in a ceramic container.

8. The method of claim 1 wherein a minor amount of aluminum or lead is present in the molten zinc.

9. The method of claim 8 wherein 0.16 to 0.18 percent of aluminum is present in the molten zinc.

* * * * *